US007044173B2

(12) United States Patent
Silver

(10) Patent No.: US 7,044,173 B2
(45) Date of Patent: May 16, 2006

(54) MICROFIBER TOWEL WITH COTTON BASE

(76) Inventor: Scott Hugh Silver, 18 Cushing Ave., Annapolis, MD (US) 21403

( * ) Notice: Subject to any disclaimer, the term of this patent is extended or adjusted under 35 U.S.C. 154(b) by 65 days.

(21) Appl. No.: 10/247,128

(22) Filed: Sep. 19, 2002

(65) Prior Publication Data

US 2004/0055659 A1 Mar. 25, 2004

(51) Int. Cl.
*D03D 27/00* (2006.01)

(52) U.S. Cl. ..... 139/396; 139/391; 139/392; 139/420 R; 139/426 R

(58) Field of Classification Search ..... 139/396, 139/391, 392, 420 R, 426 R
See application file for complete search history.

(56) References Cited

U.S. PATENT DOCUMENTS

| | | | | |
|---|---|---|---|---|
| 745,112 | A | 11/1903 | Margerison et al. | |
| 1,766,805 | A | 6/1930 | Wakefield | |
| 1,925,459 | A | 9/1933 | Parker et al. | 139/396 |
| 3,030,691 | A | 4/1962 | Law | 28/73 |
| 3,302,655 | A | 2/1967 | McHargue | 139/25 |
| 3,382,305 | A | 5/1968 | Breen | 264/171 |
| 3,700,545 | A | 10/1972 | Matsui et al. | 161/175 |
| 3,721,272 | A | 3/1973 | Hager | 139/396 |
| 3,721,273 | A * | 3/1973 | Sherrill et al. | 139/396 |
| 3,721,274 | A | 3/1973 | Sherrill et al. | 139/396 |
| 4,233,355 | A | 11/1980 | Sato et al. | 428/224 |
| 4,576,848 | A | 3/1986 | Dillon et al. | 428/89 |
| 4,726,400 | A | 2/1988 | Heiman | 139/396 |
| 5,120,598 | A | 6/1992 | Robeson et al. | 428/288 |
| 5,290,269 | A * | 3/1994 | Heiman | 604/378 |
| 5,447,182 | A | 9/1995 | Gehrig | 139/396 |
| 5,486,500 | A | 1/1996 | Kaufman | 503/227 |
| 5,555,716 | A | 9/1996 | Dugan | 57/224 |
| 5,667,865 | A * | 9/1997 | Jackson et al. | 428/92 |
| 5,759,926 | A | 6/1998 | Pike et al. | 442/333 |
| 5,887,311 | A * | 3/1999 | Kresse et al. | 15/228 |
| 6,247,505 | B1 * | 6/2001 | Worman | 139/396 |
| 6,360,374 | B1 * | 3/2002 | Adler | 2/207 |
| 2002/0079014 | A1 | 6/2002 | Hamby et al. | 139/396 |

FOREIGN PATENT DOCUMENTS

| | | | |
|---|---|---|---|
| DE | 42 00 278 C1 | | 5/1993 |
| DE | 4200278 C | * | 8/1993 |
| DE | 29621156 U | * | 4/1997 |

* cited by examiner

*Primary Examiner*—John J. Calvert
*Assistant Examiner*—Robert H. Muromoto
(74) *Attorney, Agent, or Firm*—Heslin Rothenberg Farley & Mesiti P.C.; John Pietrangelo

(57) ABSTRACT

A terry fabric having increased static and dynamic absorbency includes a ground fabric having opposing first and second surfaces and woven from ground warp yarns and ground fill yarns, each of the ground warp yarns and ground fill yarns consisting of at least one cellulosic fiber; and terry warp yarns interwoven with the ground warp yarns and ground fill yarns to form terry loops extending from opposing surfaces of the ground fabric, the pile yarns consisting of microfiber.

12 Claims, 1 Drawing Sheet

MICROFIBER TOWEL WITH COTTON BASE

TECHNICAL FIELD

The invention relates to terry fabric having a cotton ground fabric and microfiber loops extending from opposing surfaces of the ground fabric, and to toweling of the terry fabric.

BACKGROUND ART

The kitchen textile and bath towel industry is a very competitive, commodity-driven market, and suppliers are constantly striving to develop and produce different and unique products to attract consumers. This is currently done mainly through design and color.

Consumers perceive cotton as the most desirable fiber for toweling, based on its ability to absorb water 100% cotton products dominate the traditional towel market, where the 100% cotton content is used as a major selling feature. However, 100% cotton is typically lacking in softness, and is easily stained, so there is a need for a terry fabric that is extremely soft, absorbent and stain resistant. In addition, further improvement in absorbency properties of fabrics used for toweling is also desirable. This stain resistance is very important in both kitchen and bath toweling, where a cotton towel that easily stains is unattractive and, moreover, appears less than clean and sanitary, rendering it useless in certain applications, such as the hospitality and foodservice industries.

Microfibers are very thin fibers having a linear density of less than 1 denier per filament (dpf), making these fibers even finer than silk, which has a linear density of 1 dpf. Microfibers, also known as "microdenier fibers", have silk-like properties, including the drape, flow, look, feel, movement, softness and luxuriousness of silk, which make the microfibers desirable in the fashion industry for making items such as intimate apparel, outerwear, and sportswear. Although similar to silk, synthetic microfibers also have the useful properties and performance imparted to and in common with certain man-made fibers. For example, synthetic microfibers tend to be easy to care for and often have "wash & wear" capability.

Microfibers are typically formed from composite fibers by processes well known in the art. Composite fibers are manufactured in general by combining at least two fiber-forming polymers via extrusion. One known method for producing split fiber structures includes the steps of forming fibrillizable or splittable multicomponent conjugate fibers into a fibrous structure and then treating the fibrous structure with an aqueous emulsion of benzyl alcohol or phenyl ethyl alcohol to split the composite fibers. Another known method has the steps of forming splittable conjugate filaments into a fibrous structure and then splitting the conjugate fibers of the fibrous structure by flexing or mechanically working the fibers in the dry state or in the presence of a hot aqueous solution. Yet another method for producing split fibers is a needling process. In this process, conjugate fibers are hydraulically or mechanically needled to fracture and separate the cross-sections of conjugate fibers, forming fine denier split fibers. FIG. 1 shows a cross-section of a splittable fiber with pie-shaped segment before splitting.

Microfibers composed of glass, polyolefin, polyester, polyamide, and cellulosic materials have been described in the patent literature. For example, U.S. Pat. No. 3,700,545 discloses a multi-segmented (i.e., multilayered) polyester or polyamide fiber having at least 10 fine segments (layers) with cross sectional shapes and areas irregular and uneven to each other. The spun fibers are treated with an alkali or an acid to decompose and remove at least a part of the polyester or polyamide. U.S. Pat. No. 3,382,305 discloses a process for the formation of microfibers having an average diameter of 0.01 to 3 microns by blending two incompatible polymers and extruding the resultant mixture into filaments and further dissolving one of the polymers from the filament. U.S. Pat. No. 5,120,598 describes ultra-fine polymeric fibers for cleaning up oil spills. The fibers were produced by mixing a polyolefin with polyvinyl alcohol and extruding the mixture through a die followed by further orientation. The polyvinyl alcohol is extracted with water to yield ultra-fine polymeric fibers. EP-A-498,672 discloses microfiber-generating fibers of island-in-the-sea type obtained by melt extrusion of a mixture of two polymers, whereby the sea polymer is soluble in a solvent and releases the insoluble island fiber of fineness of 0.01 denier or less. Described is polyvinyl alcohol as the sea polymer. U.S. Pat. No. 4,233,355 discloses a separable unitary composite fiber comprised of a polyester or polyamide which is insoluble in a given solvent and a copolyester of ethylene terephthalate units and ethylene 5-sodium sulfoisophthalate units, which is soluble in a given solvent. The composite fiber was treated with an aqueous alkaline solution to dissolve out at least part of the soluble polymer component to yield fine fibers. The cross sectional views of the composite fibers show an "islands-in-the-sea" type, where the "islands" are the fine fibers of the insoluble polymer surrounded by the "sea" of the soluble polymer.

U.S. Pat. No. 6,247,505 and DE 4200278 disclose a terry fabric wherein the carrier fabric is composed of cotton fiber, with cotton loops extending from one side and polyamide microfiber loops extending from the other side. The fabric is intended for use as a towel or bathrobe, and the U.S. patent states "when processed into a towel or bathrobe, they readily absorb the moisture on the skin of the user and transfer it to the outside" (col 3, lines 65–67). Such a fabric is not suitable for use as a kitchen or bath towel, since it is undesirable for liquid absorbed when wiping a hard surface to pass through the towel to the opposite surface, wetting the hand of the user Accordingly, there is a need for a terry fabric that wicks moisture away from a point of contact with a liquid on a hard surface to the interior of the towel, and spreads the moisture throughout the cotton ground fabric in both longitudinal and horizontal directions. There is also a need for a terry fabric for use in toweling that absorbs water quickly and holds the water away from all surfaces of the towel.

SUMMARY OF THE INVENTION

It has been unexpectedly discovered that a terry fabric having a cellulosic ground fabric with microfiber loops extending from both surfaces displays surprisingly high static and dynamic water absorption, particularly with respect to 100% cotton terry. The fabric wicks moisture into the ground fabric, spreads it throughout the cotton fibers of the ground, so that it is held away from exterior surfaces of the towel and away from contact with the user's skin.

DETAILED DESCRIPTION

Figure 1:
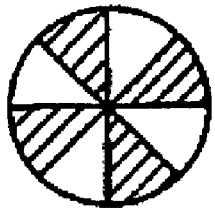
FIG. 1 is a cross-sectional view through a conjugate fiber, splittable to form a plurality of microfibers.

A terry fabric in accordance with the present invention is illustrated in FIG. 1. Terry fabric 1 comprises woven ground or carrier fabric, mat or web 2, which is woven from ground warp yarns 10 and ground fill yarns 11. Each set of ground warp yarns 10 and ground fill yarns 11 is independently composed of at least one cellulosic fiber or a blend of polyester fiber and cellulosic fibers, and the composition of each of ground warp yarns 10 and ground fill yarns 11 may vary from the other. In particular, the cellulosic fiber may be cotton or a blend of cotton and rayon fibers. For example, ground warp yarns 10 may be composed of 100% cotton, while ground fill yarns 11 are composed of a cotton/rayon blend. Suitable cellulosic fibers include cotton and rayon, and a particularly suitable cellulosic fiber is cotton. Although it is not essential, each set of ground warp yarns 10 and ground fill yarns 11 are typically composed of 100% cotton fiber, as cotton combines an excellent capability for water retention with low cost.

Figure 2:
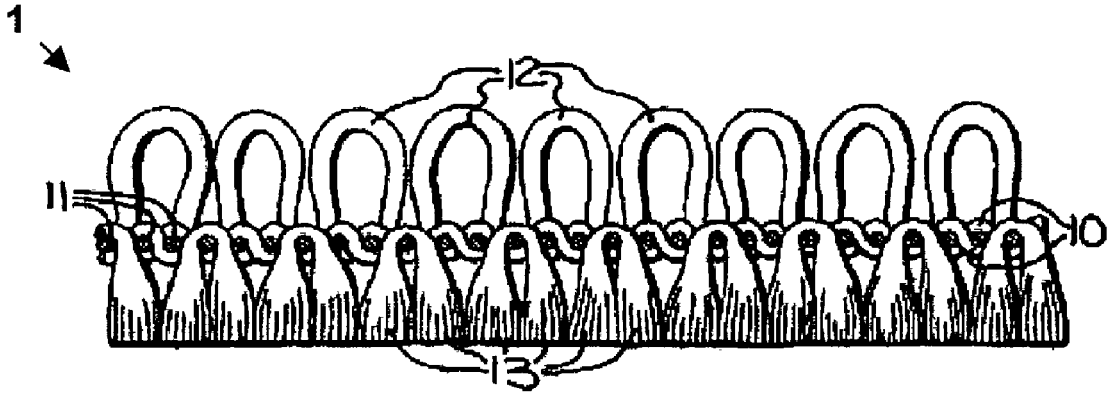
FIG. 2 is a longitudinal view through a terry fabric according to the present invention.

Terry warp or pile yarns 12 and 13 are interlaced with ground warp yarns 10 and ground fill yarns 11 during the weaving process and extend from opposing surfaces of ground fabric 2. Both sets of terry warp yarns are composed of microfiber, and, in particular, polyester microfiber. Terry warp yarns 12 and 13 may be sheared to produce a terry velour as illustrated in FIG. 2, or left unsheared as a full loop pile (not shown).

In one embodiment, a terry fabric according to the invention is composed of 300 denier microfiber polyester yarns in the terry pile, with at least 288 filaments per denier, and 16/1 ring spun 100% cotton yarns in both the ground warp and weft.

The terry fabric of the present invention is particularly advantageous in that it has an unexpectedly high capacity for holding moisture and an unexpectedly high rate of wicking. These properties are a direct result of the configuration of the microfibers and cotton fibers used in the terry fabric of the invention. During a drying operation, moisture is rapidly absorbed on the surface of the finely divided microfibers making up the terry loops, and is wicked away from both exterior pile faces of the towel. The moisture is moved toward the interior of the towel, where it is taken up by the cotton fiber of the ground fabric, and distributed throughout the ground fabric in both the warp and weft directions. This results in a towel that is perceptively better at drying a wet surface than an ordinary all-cotton towel, as a towel according to the present invention produces a dry surface very quickly and absorbs a large amount of water. In addition, after the towel is saturated, the excess moisture may be wrung out, and the towel may be dried very rapidly. When mechanically dried a towel according to the present invention dries 50% quicker than an all-cotton towel of the same weight, therefore reducing energy requirements drying the towel. In tests conducted on a towel according to the present invention, the towel absorbed about 800% of its dry weight in water, about twice as much as an all-cotton towel, of the identical net unit weight. In addition, the rate of water absorption was almost three times greater than that of an all-cotton towel.

Accordingly, in another aspect, the invention relates to a method for increasing static and dynamic absorbency of a terry fabric comprising cotton fiber, The method includes weaving a ground fabric from warp and fill yarns including at least one cellulosic fiber, and interlacing pile yarn consisting of microfiber with the warp and fill yarn, to form terry loops on opposing sides of the ground fabric. The terry loops are capable of wicking moisture away from both surfaces of the terry fabric into the ground fabric. As a result, static and dynamic absorbency of the fabric is increased relative to a fabric having a cotton pile yarn forming terry loops on one or both surfaces of the ground. In particular, the cellulosic fiber may be cotton or a blend of cotton and rayon fibers; the microfiber is typically polyester.

In yet another aspect, the invention relates to a method for drying a wet surface with a towel. The method includes providing a towel according to the invention; contacting the wet surface with the towel; wicking moisture away from the wet surface via the terry warp yarns; absorbing the moisture into the ground warp yarns and ground fill yarns; and distributing moisture along the ground fabric in both warp and weft directions. As a result, the wet surface is dried and moisture removed from it is held away from both surfaces of the towel.

Besides the surprising advantages of a fabric according to the present invention in drying, the fabric has other beneficial properties. It is also lint-free, scratch-free, and stain resistant. It is machine washable and antimicrobial. It can be used to clean greasy surfaces, as it attracts and holds grease. A towel according to the invention is "oleophilic" and naturally attracts grease, and fibers making up the towel absorb oily stains and hold them tenaciously.

Due to the construction and design of this fabric, the fabric may be woven with dyed yarns in a grid check or stripe pattern, so that towels may be coordinated with the room's decor.

EXAMPLES

Towels (2) containing 100% polyester microfiber in the pile and 100% Cotton yarns in the ground (designated Towel A in the table) were compared to towels made of 100% Cotton yarn in the pile as well as the ground (designated Towel B in the table). The samples were evaluated by MTL Testing Laboratories using Test No. MC 361143 (US) to determine absorbency, drying rate, wicking, dimensional changes, and appearance after washing and lint generation after drying. Results are summarized in Table 1.

TABLE 1

| Tests Performed | | Towel A - cotton/microfiber | Towel B - cotton |
|---|---|---|---|
| Dynamic Absorbency | Initial | 1.43 g/sec | 0.565 g/sec |
| | Secondary | 0.015 g/sec | 0.005 g/sec |
| Static Absorbency | Total Saturation or % water retained | 781.50% | 416.60% |
| Drying rate | % | 24.77% | 54.72% |
| Wicking | Inch @ 5 min. | 2.0 inches @ 5 min. | 0.93 inches @ 5 min. |
| Dimensional Stability | Length: | −6.67% | −6.83% |
| | Width: | +0.67% (growth) | −1.33% |
| Appearance | Class | Class 4.5 | Class 4.0 |
| Lining | Drying #1: | 0.0001 g | 0.0037 g |
| | Drying #2: | 0.0004 g | 0.0045 g |
| | Drying #3 | 0.0008 g | 0.0009 g |

The invention claimed is:

1. A terry fabric having increased static and dynamic absorbency, said terry fabric comprising:

a ground fabric having opposing first and second surfaces and woven from ground warp yarns and ground fill yarns, each of said ground warp yarns and ground fill yarns consisting of at least one cellulosic fiber; and terry warp yarns interwoven with said ground warp yarns and ground fill yarns to form terry loops extending from opposing surfaces of the ground fabric, said terry warp yarns consisting of microfiber.

2. A terry fabric according to claim 1, wherein said at least one cellulosic fiber comprises cotton.

3. A terry fabric according to claim 1, wherein said at least one cellulosic fiber comprises a blend of cotton and rayon fibers.

4. A terry fabric according to claim 1, wherein said microfiber comprises polyester.

5. A terry fabric according to claim 1, wherein the terry loops extending from at least one surface of the ground fabric are sheared to form a velour surface.

6. A kitchen or bath towel comprising the terry fabric of claim 1.

7. A method for increasing static and dynamic absorbency of a terry fabric comprising cotton fiber, said method comprising:

weaving a ground fabric from warp and fill yarns comprising at least one cellulosic fibers; and interlacing pile yarn consisting of microfiber with the warp and fill yarn, to form terry loops on opposing sides of the ground fabric, said terry loops being capable of wicking moisture away from a surface of the terry fabric into the ground fabric; and whereby static and dynamic absorbency of the fabric is increased relative to a fabric having a cotton pile yarn forming terry loops on one or both surfaces of the ground.

8. A method according to claim 7, wherein said at least one cellulosic fiber comprises cotton.

9. A method according to claim 7, wherein said at least one cellulosic fiber comprises a blend of cotton and rayon fibers.

10. A method according to claim 7, wherein said microfiber comprises polyester.

11. A method according to claim 7, wherein the terry loops extending from at least one surface of the ground fabric are sheared to form a velour surface.

12. A method for drying a wet surface with a towel, said method comprising:

providing a towel according to claim 6;

contacting the wet surface with the towel;

wicking moisture away from the wet surface via the terry warp yarns; absorbing the moisture into the ground warp yarns and ground fill yarns; and distributing moisture along the ground fabric in both warp and weft directions;

whereby the wet surface is dried and moisture removed therefrom is held away from surfaces of the towel.

* * * * *